US012311502B1

(12) United States Patent
Patel et al.

(10) Patent No.: US 12,311,502 B1
(45) Date of Patent: May 27, 2025

(54) ELECTRONIC DEVICE SCREEN POLISHING APPARATUS AND METHOD FOR THE SAME

(71) Applicant: Communications Test Design, Inc., West Chester, PA (US)

(72) Inventors: Kartik R. Patel, Coatesville, PA (US); Robel Tadele, West Chester, PA (US); Ryan Smith, Boothwyn, PA (US); Matthew Genatempo, West Chester, PA (US)

(73) Assignee: Communications Test Design, Inc., West Chester, PA (US)

( * ) Notice: Subject to any disclaimer, the term of this patent is extended or adjusted under 35 U.S.C. 154(b) by 0 days.

(21) Appl. No.: 18/956,100

(22) Filed: Nov. 22, 2024

Related U.S. Application Data

(60) Provisional application No. 63/678,803, filed on Aug. 2, 2024.

(51) Int. Cl.
*B24B 7/24* (2006.01)

(52) U.S. Cl.
CPC ..... *B24B 7/24* (2013.01)

(58) Field of Classification Search
CPC .... B24B 7/00; B24B 7/20; B24B 7/22; B24B 7/224; B24B 7/24; B24B 7/242; B24B 7/244; B24B 7/245; B24B 57/00; B24B 57/02; B24B 41/053; B23B 2226/45
See application file for complete search history.

(56) References Cited

U.S. PATENT DOCUMENTS

| | | | |
|---|---|---|---|
| 1,072,654 | A | 9/1913 | Rorabeck |
| 9,703,325 | B2 | 7/2017 | Pope et al. |
| 10,007,934 | B2 | 6/2018 | Nguyen |
| 10,127,647 | B2 | 11/2018 | Forutanpour et al. |
| 10,169,858 | B2 | 1/2019 | Humphrey et al. |
| 10,753,882 | B1 | 8/2020 | Mahajan et al. |
| 10,810,732 | B2 | 10/2020 | Dwivedi et al. |
| 10,867,381 | B2 | 12/2020 | An |
| 11,010,884 | B2 | 5/2021 | Nabavi et al. |
| 11,151,712 | B2 | 10/2021 | Liu et al. |
| 11,205,259 | B2 | 12/2021 | Li et al. |
| 11,334,981 | B2 | 5/2022 | Liu et al. |
| 11,574,182 | B2 | 2/2023 | Matthews et al. |
| 11,645,742 | B2 | 5/2023 | Hu et al. |
| 11,803,954 | B2 | 10/2023 | Forutanpour et al. |
| 11,900,589 | B2 | 2/2024 | Liu et al. |

(Continued)

FOREIGN PATENT DOCUMENTS

| | | | | |
|---|---|---|---|---|
| CN | 206440635 U | | 8/2017 | |
| CN | 109108799 A | * | 1/2019 | ..... B24B 29/005 |

(Continued)

*Primary Examiner* — C. A. Rivera
(74) *Attorney, Agent, or Firm* — Bradley M. Brown

(57) ABSTRACT

An electronic device screen polishing apparatus and a method for the same are shown and described. The electronic device screen polishing apparatus includes a frame creating a first compartment. The first compartment houses a polishing device positioned above a movable table. A computer having a non-transient storage medium is housed within the frame. A logic stored on the non-transient storage medium. The logic defines a polishing sequence. The polishing sequence defines polishing of an electronic device screen.

9 Claims, 11 Drawing Sheets

(56) References Cited

U.S. PATENT DOCUMENTS

| | | | |
|---|---|---|---|
| 2018/0232875 | A1 | 8/2018 | Kanodia et al. |
| 2021/0116392 | A1 | 4/2021 | Fitzgerald et al. |
| 2023/0042544 | A1 | 2/2023 | Lee et al. |
| 2023/0368361 | A1 | 11/2023 | Song et al. |
| 2023/0384235 | A1 | 11/2023 | Wu et al. |
| 2024/0029227 | A1 | 1/2024 | Pallerla et al. |
| 2024/0070840 | A1 | 2/2024 | Wang et al. |
| 2024/0070851 | A1 | 2/2024 | Park |
| 2024/0087276 | A1 | 3/2024 | Silva et al. |

FOREIGN PATENT DOCUMENTS

| | | | | | |
|---|---|---|---|---|---|
| CN | 110253410 | A | * | 9/2019 | ..... B24B 29/02 |
| CN | 110378902 | B | | 12/2019 | |
| CN | 211221443 | U | | 8/2020 | |
| CN | 110253410 | B | | 4/2021 | |
| CN | 11007524 | B | | 5/2021 | |
| CN | 110695773 | B | | 6/2021 | |
| CN | 111289536 | B | | 10/2021 | |
| CN | 111272231 | B | | 4/2022 | |
| CN | 11459416 | A | | 5/2022 | |
| CN | 111612763 | B | | 6/2022 | |
| CN | 114750054 | A | * | 7/2022 | |
| CN | 106670127 | B | | 8/2022 | |
| CN | 217621444 | U | | 10/2022 | |
| CN | 115272296 | A | | 11/2022 | |
| CN | 115504679 | A | | 12/2022 | |
| CN | 111311556 | B | | 2/2023 | |
| CN | 110570393 | B | | 6/2023 | |
| CN | 111325717 | B | | 8/2023 | |
| CN | 219697705 | U | | 9/2023 | |
| CN | 116503382 | B | | 10/2023 | |
| CN | 117078672 | A | | 11/2023 | |
| JP | 7248991 | B1 | | 3/2023 | |
| KR | 101459638 | B1 | | 11/2014 | |
| KR | 101629744 | B1 | | 6/2016 | |
| KR | 101926348 | B1 | | 12/2018 | |
| KR | 20200066975 | A | | 6/2020 | |
| TW | 588826 | U | | 1/2020 | |
| WO | 2023283582 | A1 | | 1/2023 | |

* cited by examiner

ELECTRONIC DEVICE SCREEN POLISHING APPARATUS AND METHOD FOR THE SAME

CROSS REFERENCE TO RELATED APPLICATIONS

This application claims the benefit of U.S. Provisional Application No. 63/678,803 filed on Aug. 2, 2024. The above identified patent application is herein incorporated by reference in its entirety to provide continuity of disclosure.

BACKGROUND OF THE INVENTION

Technology is always advancing and has done so at a rapid pace for the last several decades. Technology has become sophisticated, smaller, and accessible across the globe. This has led to technology becoming integral in everyday life. As with any integral element of life, the demand is high. This high demand has led to a rise in the cost of technological devices.

In addition to high demand, the simple replacement of devices can be expensive. If one merely discards older equipment or equipment with minor defects for a brand-new piece the cost can escalate quickly. If, however, technology is upgraded, or repaired this process can be much more cost effective for both the company and consumer.

Often times used electronic devices include a very hard glass screen. These screens may not crack as often as they once did, but they tend to become scuffed with shallow scratches. Customers do not want to open a renewed device and see a scratched screen. One way to address this issue is to replace the entire screen. However, this requires opening the device, which can limit water resistance or become expensive.

Another way to tackle the screen scratching is to polish the screen to remove the scratches. However, this comes with a whole other set of challenges. If the polishing does not take place at the correct angle the screen can show swirls or other scratching. Further, if the polishing process heats the screen over a certain threshold damage can occur. This renders the screen inoperable, and potentially the entire device.

Many companies have been taking advantage of the repair instead of discard philosophy. Further, many consumers are happy purchasing a lightly used and repaired device instead of a brand new one. However, these processes come with new challenges in order to remain effective. Consequently, there is always a need for an improvement in the art.

SUMMARY OF THE INVENTION

The present invention provides an electronic device screen polishing apparatus and method for the same wherein the same can be utilized for providing convenience for the user when cleaning up and renewing an electronic device without replacing the screen. The electronic device screen polishing apparatus has a frame creating a first compartment. The first compartment houses a polishing device positioned above a movable table. A computer having a non-transient storage medium is stored within the frame. A logic stored on the non-transient storage medium, wherein the logic defines a polishing sequence. The polishing sequence defines polishing of an electronic device screen.

Another object of the electronic device screen polishing apparatus is to have the polishing machine be secured to an actuator. The actuator moves the polishing machine in a vertical direction.

Another object of the electronic device screen polishing apparatus is to have the actuator is configured to apply a specific designated pressure to the polishing machine. The pressure is created between an electronic device screen and the polishing machine.

Another object of the electronic device screen polishing apparatus is to have a first actuator secured to the movable table. The first actuator moves the movable table in a X direction.

Another object of the electronic device screen polishing apparatus is to have a second actuator secured to the first actuator. The second actuator moves the movable table in a Y direction.

Another object of the electronic device screen polishing apparatus is to have a platform secured to the movable table. The platform includes a plurality of sidewalls which secure an electronic device therein.

Another object of the electronic device screen polishing apparatus is to have a polishing pad secured to the polishing device.

Another object of the electronic device screen polishing apparatus is to have a specialized chuck secured to the polishing device. The polishing pad is secured to the polishing device via a tool head which is secured to the special chuck which is secured to the polishing device.

Another object of the electronic device screen polishing apparatus is to have the specialized chuck is comprised of a threaded section at one end. A cylindrical opening at the opposite end. At least one screw aperture in communication with the cylindrical opening.

Another object of the electronic device screen polishing apparatus is to have the specialized chuck further include a barrel wherein the cylindrical opening inters the barrel at one end and the threaded section is attached to an opposite end.

Another object of the electronic device screen polishing apparatus is to have the at least one set screw aperture enters a side of the barrel.

Another object of the electronic device screen polishing apparatus is to have an apparatus for extruding polishing paste, wherein the apparatus for extruding polishing paste is secured above the movable table.

Another object of the electronic device screen polishing apparatus is to have the apparatus for extruding polishing paste include a mounting bracket having an actuator secured thereto. The actuator is placed in line with a container holding compartment. An extruder is secured to the mounting bracket below the container holding compartment such that one end will be in fluid contact with an open end of a container when the container is placed in the container holding compartment.

Another object of the electronic device screen polishing apparatus is to have the container configured such that when a container is forced toward the extruder the contents of the container will be forced though the nozzle end of the extruder in a desired amount.

Another object of the electronic device screen polishing apparatus is to have the polishing sequence uniformly polishes the entirety of the electronic device screen.

Another object of the electronic device screen polishing apparatus is to have the polishing sequence first polishes preidentified deep scratches located on the electronic device screen and second uniformly polishes the entirety of the electronic device screen.

Other objects, features and advantages of the present invention will become apparent from the following detailed description taken in conjunction with the accompanying drawings.

BRIEF DESCRIPTION OF THE DRAWINGS

The accompanying drawings are incorporated in and are to be considered part of the present specification. These drawings are meant to aid the reader's understanding and comprehension of the present disclosure and are depictions of various example embodiments. The drawings are not to be considered limiting upon the disclosure. It should specifically be noted that the drawings are examples and may not necessarily be drawn to scale.

DETAILED DESCRIPTION OF THE INVENTION

For the purposes of presenting a brief and clear description of the present invention, a preferred embodiment will be discussed as used for the electronic device screen polishing apparatus and method for the same. The figures are intended for representative purposes only and should not be considered to be limiting in any respect.

Figure 1:
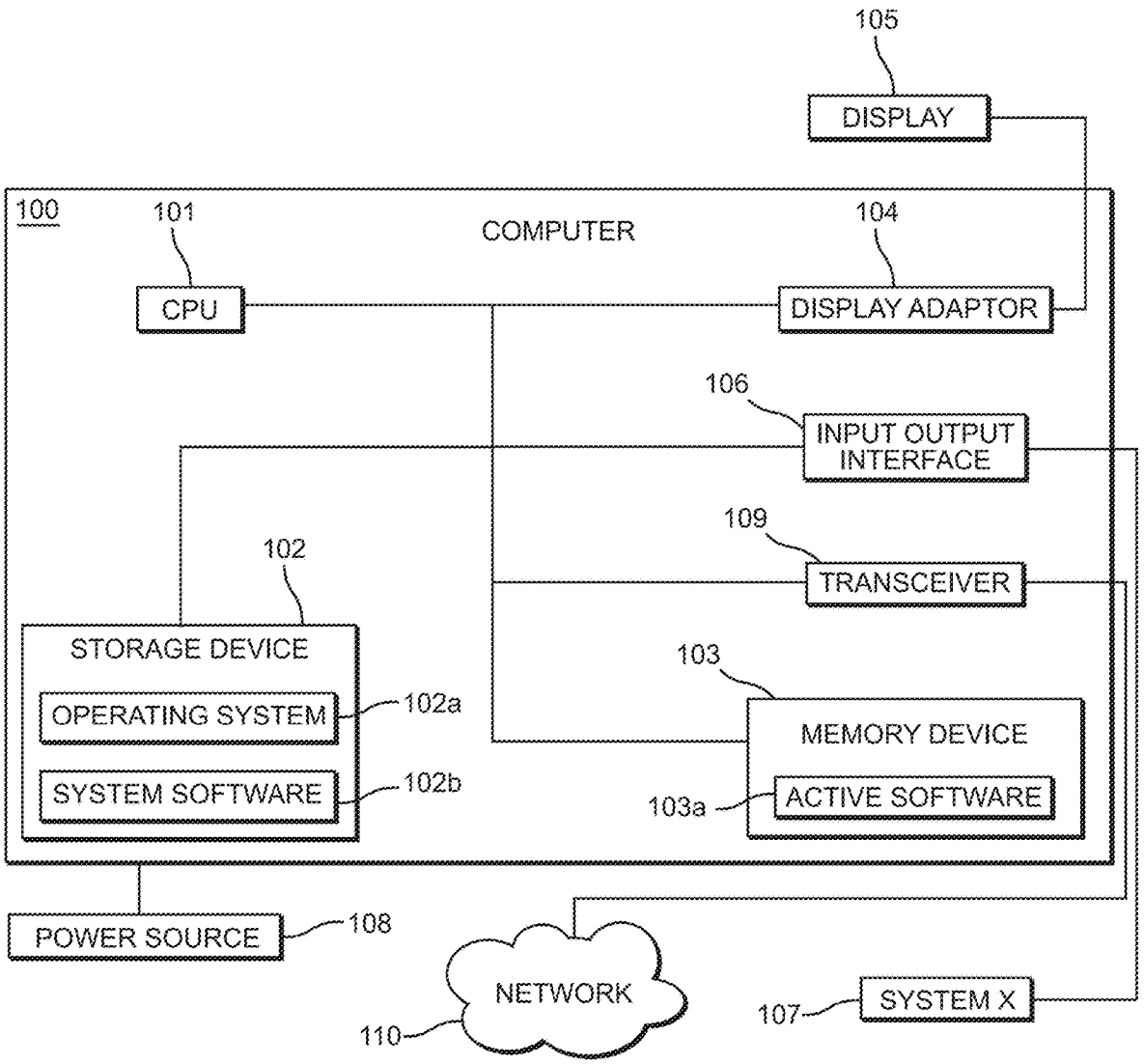
FIG. 1 shows a block diagram of a computing system.

Referring now to FIG. 1, there is shown a block diagram of a computing system. Computing systems may have many interchangeable parts or multiples of some parts. One of ordinary skill in the art will understand that the shown computer 100 is a basic computing system demonstrating a minimal amount of parts to allow for the computer to function. Computer 100 is exemplary, and one of ordinary skill in the art will recognize that computer 100 may be altered as necessary to render the presently disclosed system operable or to provide a peak performance of the disclosed system.

The parts described are each operably coupled together as necessary, one of ordinary skill in the art will understand how to connect general computer components, for example by use of a mother board or other computer board. In the shown embodiment the computer 100 includes a CPU 101. In one embodiment the CPU 101 includes only one processor. In other embodiments the CPU 101 may be made up of multiple processors. Different processors will allow for different computing power and speed.

The computer 100 includes at least one storage device 102. In different embodiments the at least one storage device 102 may be a solid-state storage device, a disk storage device, or another suitable storage device. One of ordinary skill in the art will recognize that there are several types of computing storage devices each providing well-known benefits and drawbacks. The at least one storage device 102 will store at least the computer operating system 102*a* and system software 102*b*. System software 102*b* may include any software necessary, or optionally, used to run any system described herein.

The computer 100 will have at least one memory device 103. One of ordinary skill in the art will recognize that there are several types of computing memory devices each providing well known benefits and drawbacks. The at least one memory device 103 will store at any active software 103*a*. Active software 103*a* may include the operating system 102*a* or parts of the system software 102*b*. The at least one memory device 103 may store the entire system software 102*b* size and speed permitting.

The computer 100 may also include various connection ports and types. The computer 100 may have a display adaptor 104. The display adaptor 104 will allow the computer 100 to connect to at least one display 105. In other embodiments multiple displays may be connected to the display adaptor 104. Similarly, the computer 100 may include at least one input/output interface 106. The input/output interface 106 will allow the computer 100 to connect to at least one system, referred to as System X 107 in FIG. 1. The input/output interface 106 may also allow for connection to only part of System X 107 or multiple systems. The computer 100 will also be operably connected to a required power source 108.

The computer 100 may also include a transceiver 109. In one embodiment the transceiver 109 is a wired transceiver. In another embodiment the transceiver 109 is a wireless transceiver. The transceiver 109 will allow the computer 100 to connect to a network 110. The network 110 may be an internet or an intranet connection. The network 110 will allow for the computer 100 to potentially connect to multiple other computing devices. In another embodiment the network may allow for the computer 100 to connect to multiple systems. In one embodiment the computer 100 will allow for System X 107 to be connected to the network 110.

Figure 2B:
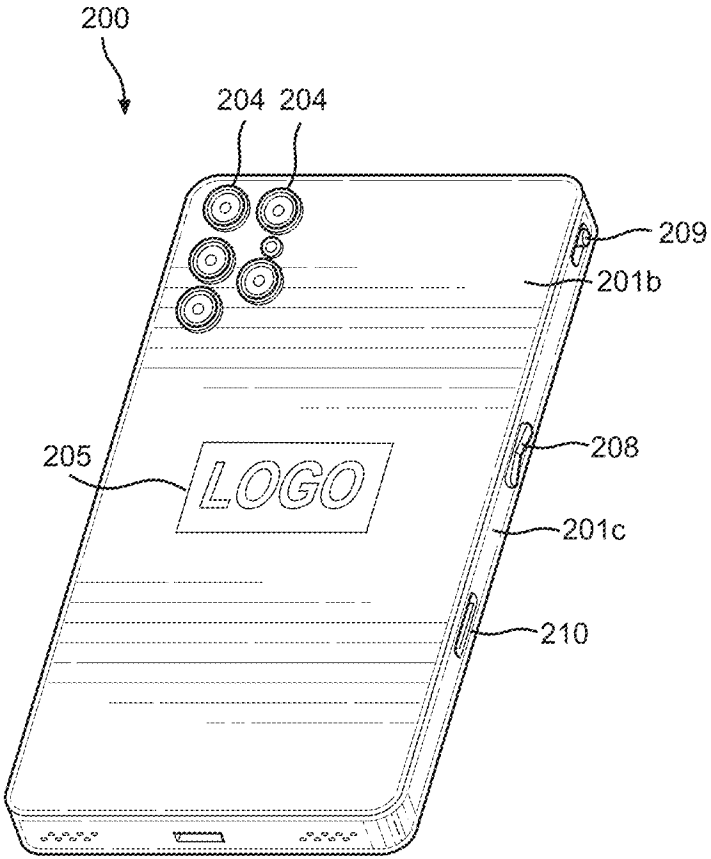
FIG. 2B shows a rear view of an example of a mobile phone device.
Figure 2A:
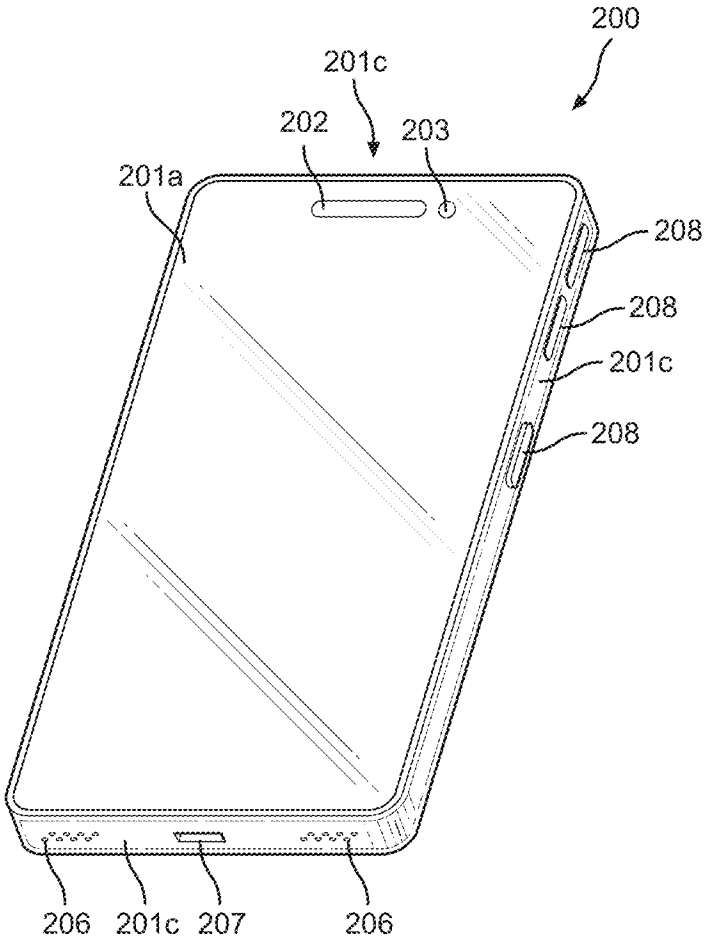
FIG. 2A shows a front view of an example of a mobile phone device.

Referring now to FIG. 2A and FIG. 2B, there is shown a front view and a rear view of an example of an electronic device 200, such as a mobile phone device. Electronic devices may have many different parts and components. Even like parts or components may be in various locations or have different shapes and sizes. One of ordinary skill in the art will understand that the shown electronic device 200 is merely an example of the exterior of a device. Any specialized or specific features or requirements of devices will be detailed herein as necessary. However, one of ordinary skill in the art will understand that many electronic devices 200 have many of these described characteristics. Further, electronic devices, such as mobile phone devices, operate on a computer-based platform having many of the computer parts as described in FIG. 1. The below description seeks to detail external components and not the computer which runs the electronic device 200. The electronic device 200 can be, without limitation, a mobile phone device, or a tablet. In one embodiment other electronic devices may be used such as laptops, cable set top boxes, routers, or antennas.

The shown electronic device 200 includes a front surface 201*a*, a rear surface 201*b*, and four side surfaces 201*c*. The front surface 201*a* typically includes a screen which covers a majority of the surface. The screen is typically covered with a specialized material, currently a glass product. The front surface 201*a* may also include a speaker opening 202 and a camera opening 203.

The rear surface 201*b* of the electronic device 200 may include at least one camera lens 204. In the shown embodiment there are a plurality of camera lenses 204. In another embodiment at least one light lens is secured to the rear surface 201*b*. In many embodiments the rear surface 201*b* includes a logo 205. The logo 205 may represent the company which created the electronic device 200. The rear surface 201*b* may include a coating or covering to decorate or protect the rear surface. For example, a coating may be applied to the rear surface 201*b* to ensure a shiny surface.

The side surfaces 201*c* of the electronic device 200 may include any or all of the following parts. In one embodiment the electronic device 200 will have several openings for speaker output 206. The electronic device 200 will also include a charging port 207. Charging ports 207 may include a prong therein to secure to a charging cord. An electronic device 200 may include a plurality of buttons 208 along the side surfaces 201*c*. In different embodiments the plurality of buttons 208 may allow for volume control, locking the electronic device 200, or other desired functions. In some embodiments the electronic device 200 may include a switch 209. In yet another embodiment the electronic device 200 includes a SIM card slot or other card slot 210.

Figure 3:
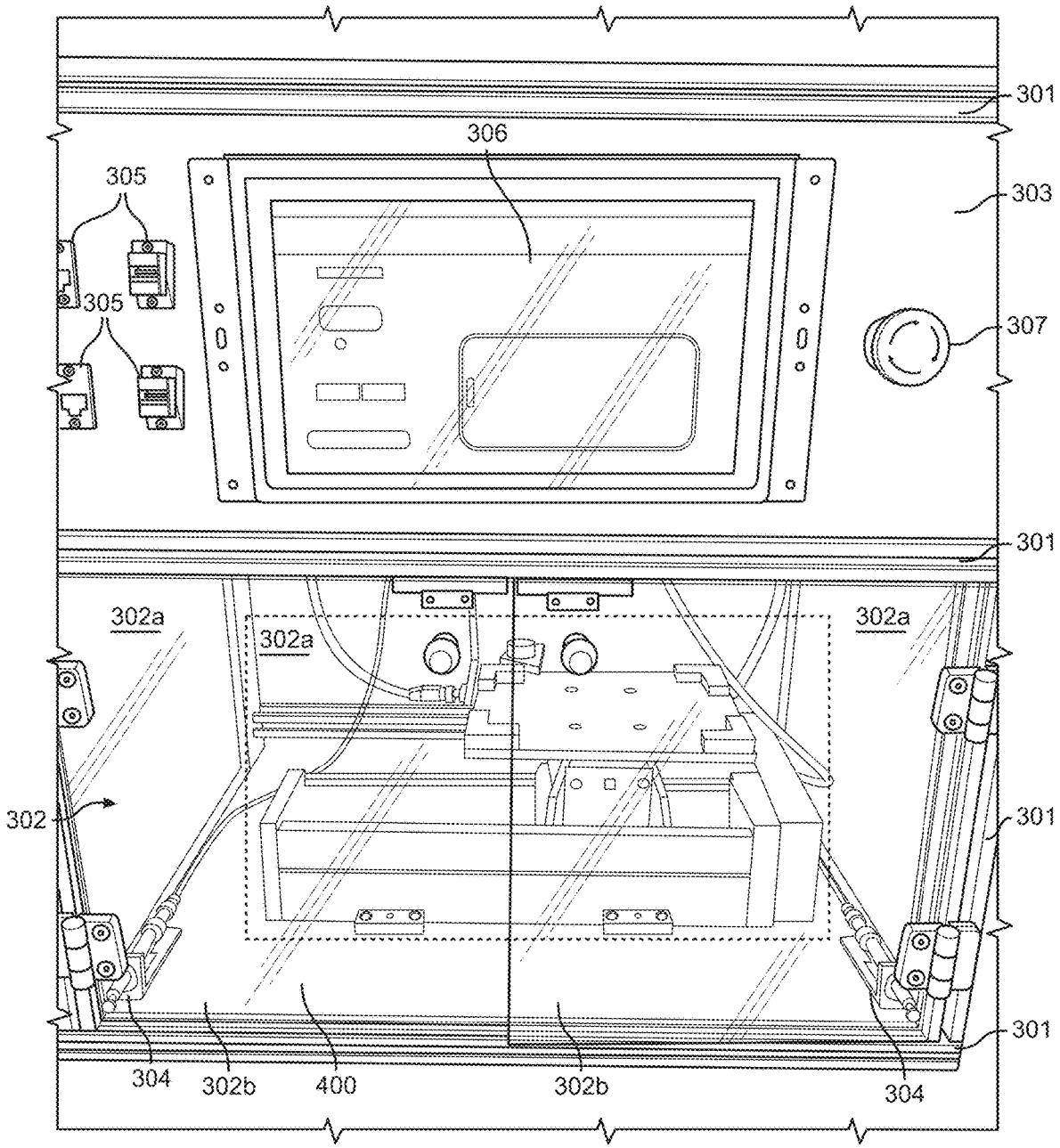
FIG. 3 shows a perspective view of an embodiment of the apparatus for electronic device screen polishing.

Referring now to FIG. 3, there is shown a perspective view of an embodiment of the apparatus for electronic device screen polishing. The apparatus includes a frame 301 making up a plurality of compartments. The first compartment 302 is shown in FIG. 3. A second compartment is behind faceplate 303 and can be used to house the electrical components as described in FIG. 5. Other compartments, while not shown may be incorporated to house additional components as needed.

The first compartment 302, houses polishing components 400 as will be described in the description of FIG. 4. In the shown embodiment the first compartment is sided with a plurality of sidewalls 302*a* and at least on door 302*b*. In some embodiments the sidewalls 302*a* and the at least on door 302*b* are clear to allow a user to see in. In other embodiments the sidewalls 302*a* and the at least one door 302*b* are opaque or of a solid color. These sidewalls 302*a* and the at least one door 302*b* will prevent polishing paste or removed particles from exiting the first compartment 302 during the polishing process.

In one embodiment the at least one door 302*b* includes a door sensor 304. In this embodiment the at least one door sensor 304 can prevent the polishing process from beginning if the door sensor 304 registers the corresponding door as open. The at least one door sensor 304 operably couples with the at least one computer.

The faceplate 303 has several apertures therethrough. The apertures allow for various components to be placed therein, allowing the faceplate 303 to support these components. In different embodiments various electrical connections 305 may be supported by the faceplate 303. These electrical connections 305 will allow for operable connections to the at least one computer.

In one embodiment the faceplate 303 supports at least one screen 306. The at least one screen 306 is operably coupled with the at least one computer. The at least one screen 306 may operate as a display to show various machine specifications such as polishing time, polishing location, phone type, and phone model. In different embodiments different information may be displayed on the screen as deemed useful or necessary by the user.

In one embodiment the faceplate 303 supports an emergency off button 307. The emergency off button 307 is operably coupled to the apparatus such that when pressed any polishing process will be immediately halted. This will allow for a user to stop the machine in the event of a less than favorable event. The inclusion of an emergency off button 307 also ensure compliance with work environment standards.

Figure 4:
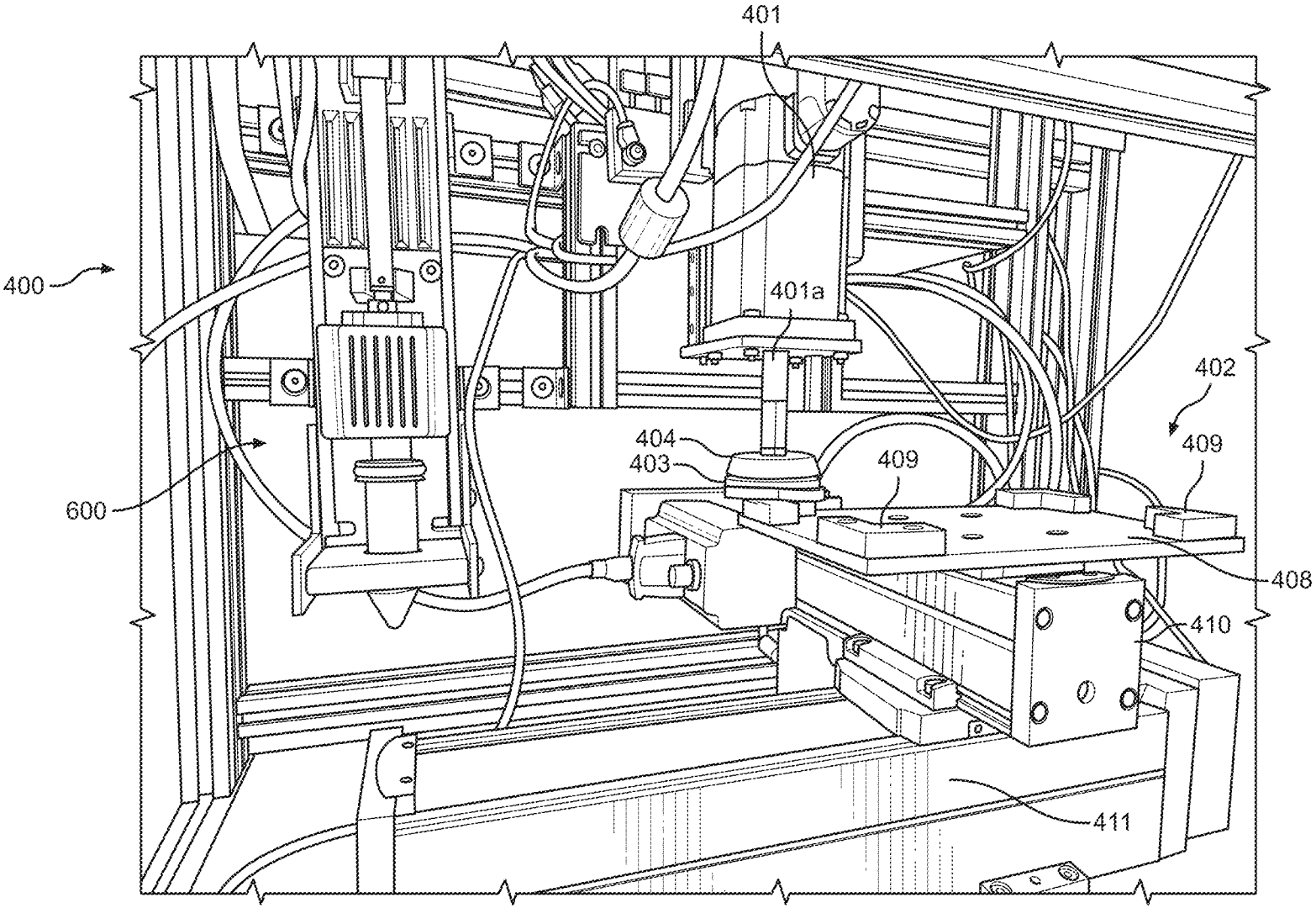
FIG. 4 shows a zoomed perspective view of an embodiment of the apparatus for electronic device screen polishing.
Figure 4A:
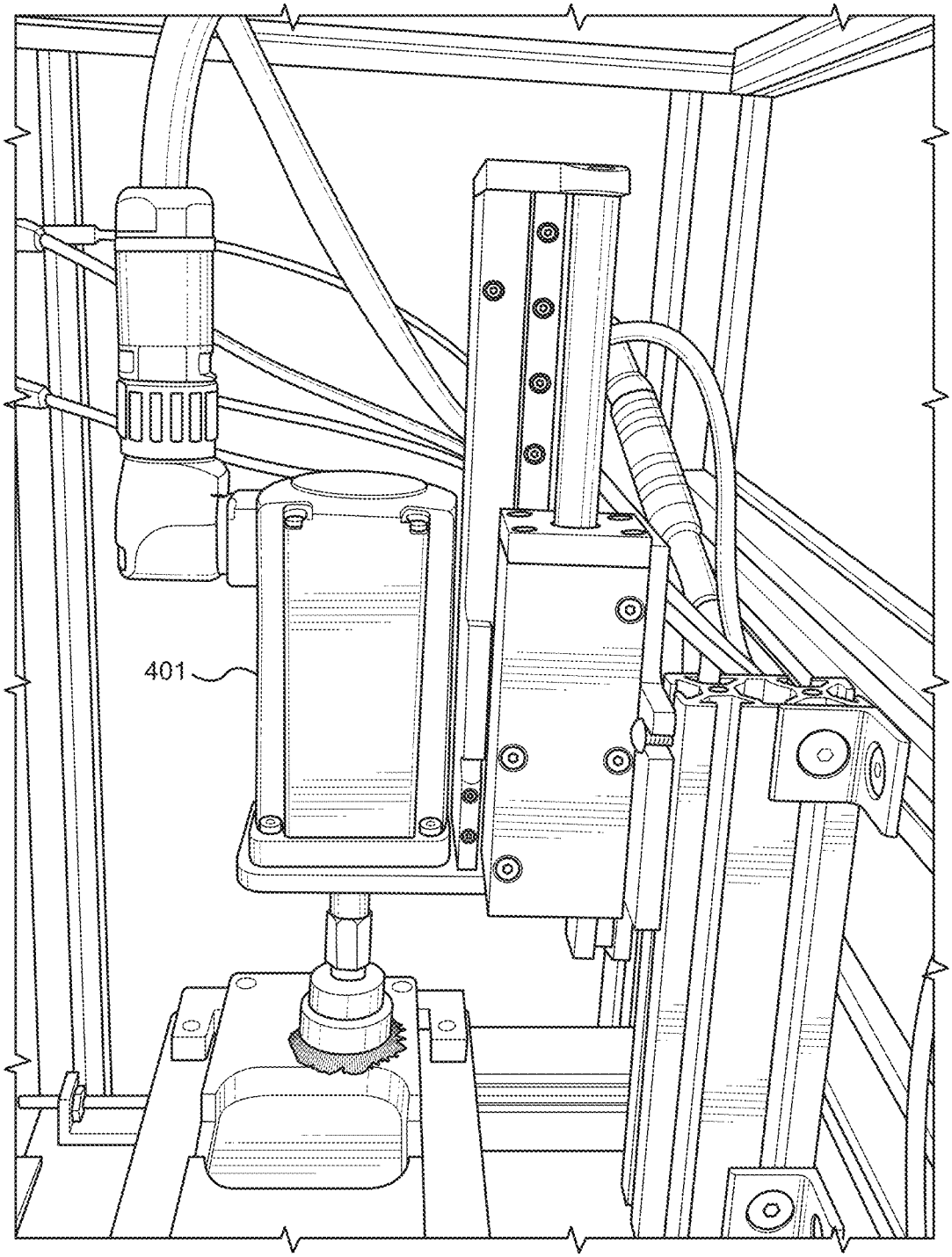
FIG. 4A shows a side view of an embodiment of the apparatus for electronic device screen polishing.
Figure 4B:
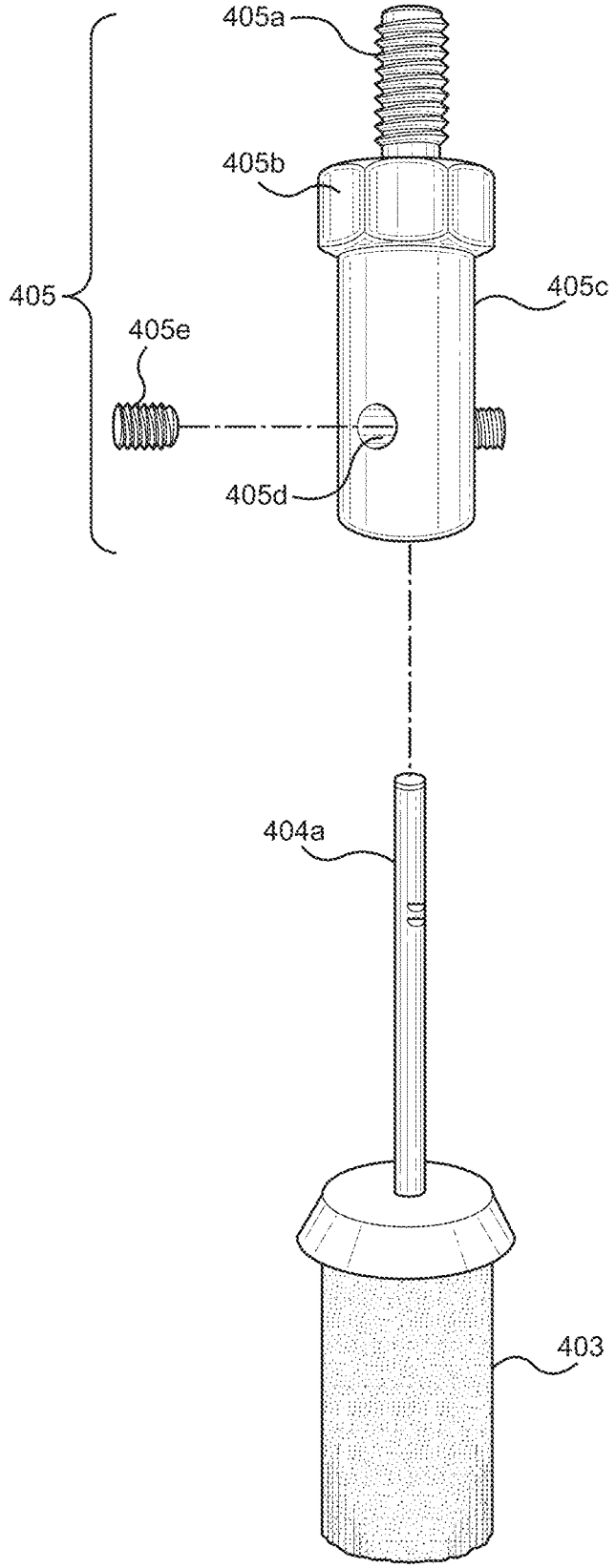
FIG. 4B shows an exploded view of an embodiment of a chuck device to secure polishing implements to the polishing machine.

Referring now to FIG. 4 and FIG. 4A and FIG. 4B, there is shown several views of an embodiment of the apparatus for electronic device screen polishing. In these FIGs. the polishing components 400 can be readily seen. In the shown embodiment the polishing components 400 include a polishing machine 401, a movable table 402, and a polishing paste extruding device 600. The polishing paste extruding device 600 will be discussed in more detail in the description of FIG. 6, FIG. 7A, and FIG. 7B.

The polishing machine 401 includes at least one polishing pad 403. In one embodiment the at least one polishing pad 403 is removably coupled to a tool head 404 of the polishing machine 401. In one embodiment different polishing pads 403 may be used throughout a polishing process. The different polishing pads 403 may have different grit to apply different levels of polishing.

In some instances, a special chuck 405 is required as shown in FIG. 4B. When the polishing machine 401 spins at such a high rate of speed and has pressure applied to the polishing pad 403 a large amount of torque is generated. In many instances this causes the polishing pad to turn within a traditional chuck and therefore not apply enough pressure or rotation to the polishing surface.

The special chuck 405 includes a threaded section 405*a* located at one end. In some embodiments the threaded section is secured to a hexagonal or flat section 405*b*. This will allow for the threaded section 405*a* to easily be screwed into the desired location. In this embodiment the threaded pattern will match that or the shank 401*a* of the polishing machine 401. The lower portion of the special chuck 405 includes a barrel 405*c*. The barrel 405*c* includes a cylindrical opening which accepts the shank 404*a* of a tool head 404 and polishing pad 403.

The barrel 405*c* further includes at least one set screw aperture 405*d*. The set screw aperture 405*d* will enable set screws 405*e* to be screwed into the cylindrical opening and secure the shank of the tool head 404*a* therein. By using set screws 405*e* the special chuck 405 prevents torque from spinning the tool head 404 and diminishing application to the polished surface.

In one embodiment the polishing machine 401 is coupled with an actuator 406. The actuator 406 will enable the polishing machine to be raised and lowered as compared to the movable table 402 in order to apply different pressures to a device. In some embodiments the actuator 406 includes technology which will allow for pressure sensing. This will enable the polishing machine 401 to have specific pressures applied. In various use cases specific pressure of the polishing pad 403 is imperative so as to not overheat the surface to be polished.

The polishing device 401 includes at least one motor (internal to the polishing machine). The at least one motor will enable the spinning of the tool head 404. In one embodiment the at least one motor will enable spinning only of one rate. In other embodiments the motor is a is configured to have an adjustable spin rate. For example, between 2200 and 3000 RPMs or between 2300 and 2800 RPMs. In one embodiment a first polish is conducted between 2700 and 3000 RPMs and a second polish happens between 2200 and 2600 RPMs.

The movable table 402 includes a platform 408. The platform is configured to support an electronic device. In many embodiments the electronic device is supported screen side up, therefore various indents may be provided in the platform 408 to enable a level support of the electronic device. In some embodiments the platform 408 also includes edge supports 409. The edge supports 409 will ensure an electronic device stays positioned on the platform 408.

The moveable table 402 is secured to a first actuator 410. The first actuator 410 enables movement of the moveable table 402 along at least one axis. In some embodiments the first actuator 410 is secured to a second actuator 411. This will enable the moveable table to move along a second axis. In this embodiment many different polishing patterns can be supported without needing to move the polishing machine 401.

Figure 5:
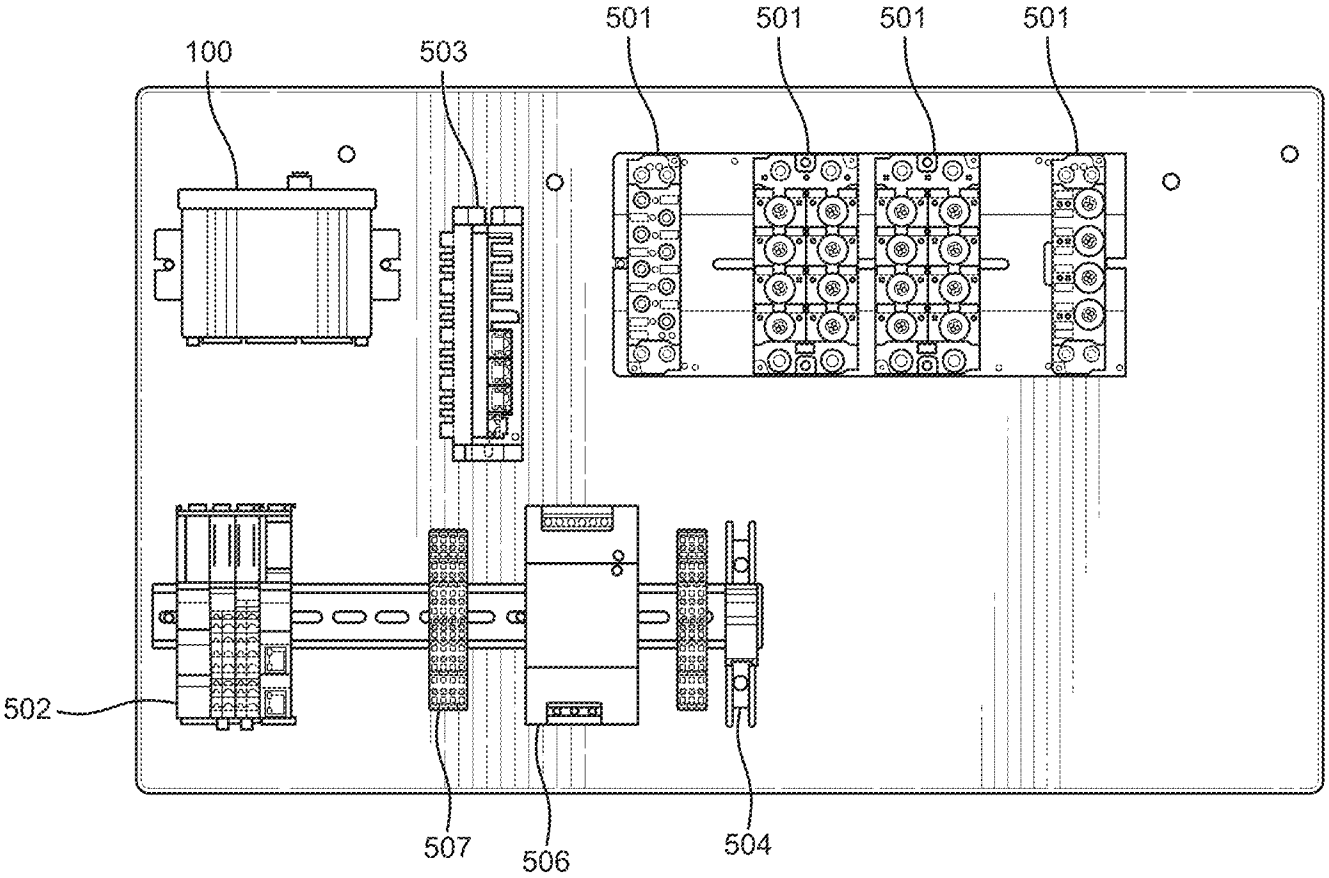
FIG. 5 shows a perspective view of an embodiment of various electrical components for the apparatus for electronic device screen polishing.

Referring now to FIG. 5, there is shown a perspective view of an embodiment of various electrical components for the apparatus for electronic device screen polishing. The electrical components needed to operate the apparatus includes at least one computer 100, which contains at least the processor and several ports. Further included is at least one etherCAT box 501. The etherCAT box(es) 501 will facilitate the necessary connections for the system to properly function. In some embodiments the electrical components also include an etherCAT gateway 502. The etherCAT gateway 502 will facilitate additional connections. In one embodiment the etherCAT gateway 502 is used to connect the safety shutoff systems to the system. In one embodiment a separate network adaptor 503 is required to connect the system to an external network.

Various components maybe used separately or together to provide power to the apparatus. In the shown embodiment there is a circuit breaker 504 placed first in the line of power supply components. The circuit breaker 504 leads to a first power terminal 505. The first power terminal 505 connects to a power supply unit 506. The power supply unit 506 will help regulate and provide the necessary power to the system. The power supply unit 506 leads to a second power terminal 507.

One of ordinary skill in the art will understand that many different electrical components exist in the market at the time of this filing. These components may be interchangeable with different components or other similar components. It is therefore to be understood that the exchange of components, which still allow for the apparatus to function or the method to be completed are contemplated by this disclosure. Numerous different component combinations exist which will allow for the apparatus to function in an identical manner.

Figure 6:
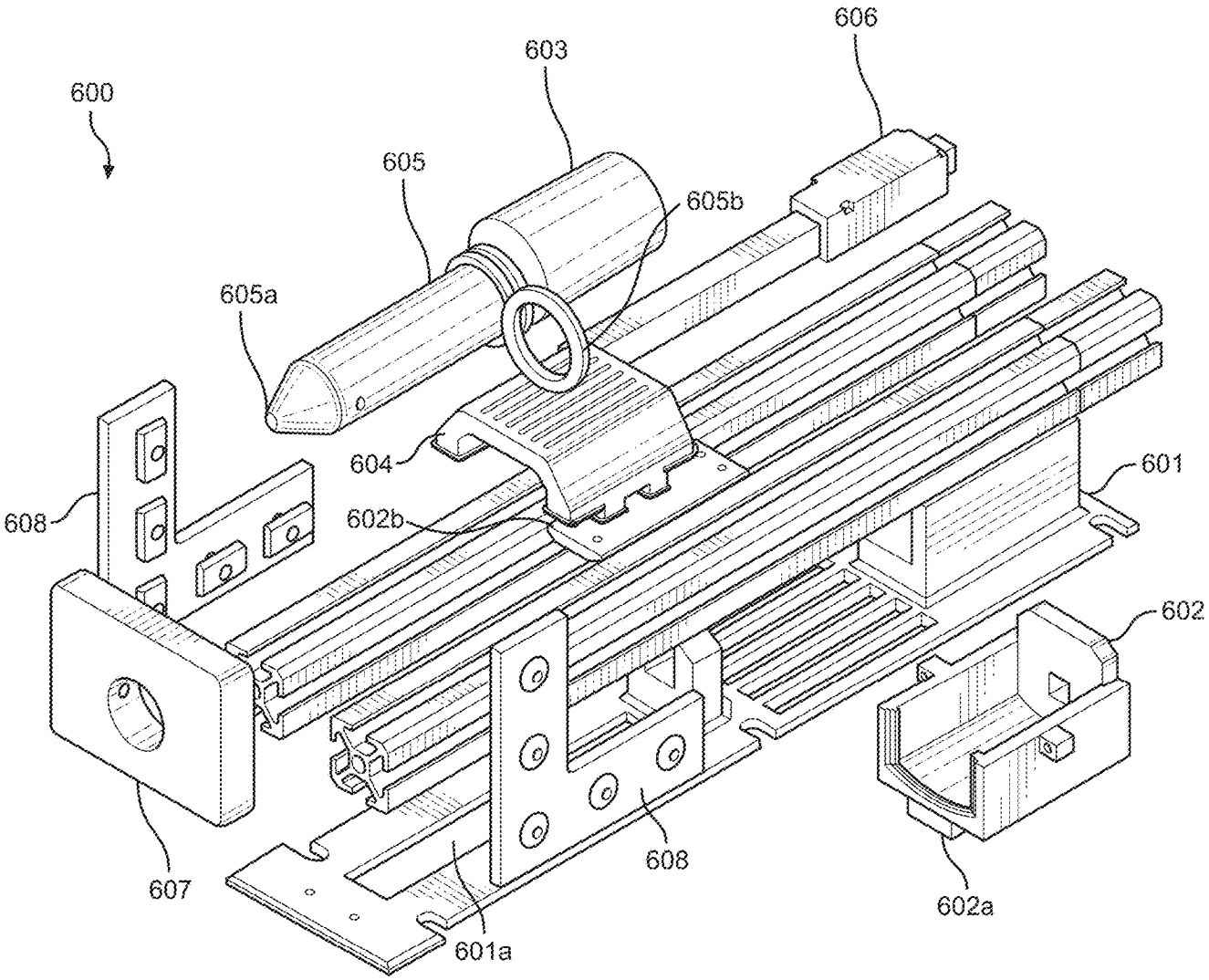
FIG. 6 shows an exploded view of an embodiment of the apparatus for extruding polishing paste.

FIG. 6 shows an exploded view of an embodiment of the apparatus for extruding polishing paste. The apparatus for extruding polishing paste 600 includes a mounting bracket 601. The mounting bracket will allow for the entirety of the apparatus 600 to be built thereon. Further, the mounting bracket 601 is configured to be secured to various different structures. This will allow for the apparatus 600 to be used in a variety of different ways.

The mounting bracket 601 has a container compartment 602 secured thereto. In one embodiment the container compartment 602 is moveably secured to the mounting bracket 601. The container compartment 602 can be configured and proportioned to fit any number of different sized and shaped containers 603. The container compartment 602 includes a lid 604 which will secure the container 603 in the container compartment 602. Further, the lid 604 will help to ensure that the container 603 does not burst during use of the apparatus.

In some embodiments the container compartment 602 has a slight protrusion 602*a* on a bottom side thereof. This protrusion 602*a* is configured to fit within a channel 601*a* on the mounting bracket 601. In one embodiment the protrusion 602*a* and the channel 601*a* will be enough to keep the container compartment 602 in line. In another embodiment there is an additional part 602*b* which is configured to secure to the protrusion 602*a* and extend wider than the channel 601*a*. In this manner the container compartment 602 is slidably secured directly to the mounting bracket 601. In some instances containers 603 may have large error tolerances. This means that containers 603 may not align perfectly with an extruder 605. This could force the container compartment 602 to rise away from the mounting bracket 601. The addition of the protrusion 602*a* and the channel 601*a* will ensure the container compartment 602 will remain in line with the extruder 605 as discussed below.

The container compartment 602 is operably coupled to an actuator 606. The actuator 606 is secured to the mounting bracket 601 such that the actuator 606 moved the container 603 when extended or retracted. In different embodiments the actuator 606 will be capable of producing different amounts of force as required by the substance of the container 603. While the substance is described as a polishing paste, this disclosure does not seek to limit the substance merely to polishing paste and it is considered that any material which may be reasonably placed in a container can be incrementally applied using this apparatus 600.

The extruder 605 is positioned adjacent to the container compartment 602 such that one end of the extruder 605 can enter the container 603. The extruder 605 includes a nozzle end 605*a* which will apply the substance to a desired surface. At the opposite end of the nozzle an O-ring 605*b* is secured to the extruder 605. In use the container 603 is pressed over the extruder 605. The O-ring 605*b* helps to ensure that the substance is forced in to the extruder 605 and is not forced out of the side of the extruder 605. In some embodiments the O-ring 605*b* provides the added benefit of allowing a secure fit in a tapering container 603 or container 603 having a varying shape.

The extruder 605 is held in place via an extruder bracket 607. In different embodiments the extruder 605 is secured to the extruder bracket 607 in various ways. In one embodiment the extruder 605 is fixed to the extruder bracket 607. In one embodiment the extruder 605 is movably fixed to the extruder bracket 607. In the shown embodiment set screws are configured to hold the extruder 605 in a desired position. The extruder bracket 607 is secured to the mounting bracket via a pair of extruder bracket supports 608. This ensures a proper placement of the extruder 605 as compared to the mounting bracket 601.

Figure 7A:
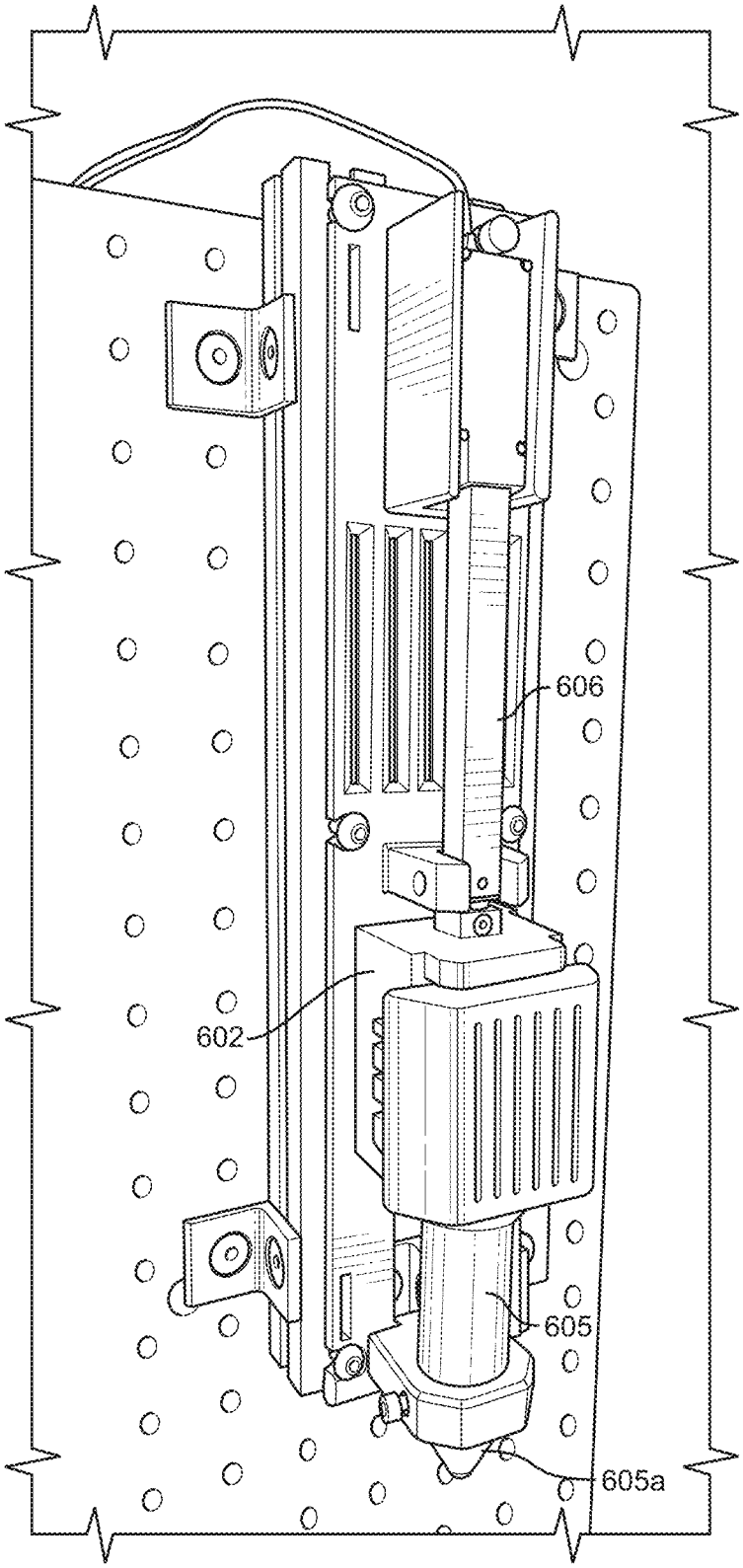
FIG. 7A shows a perspective view of an embodiment of the apparatus for extruding polishing paste.
Figure 7B:
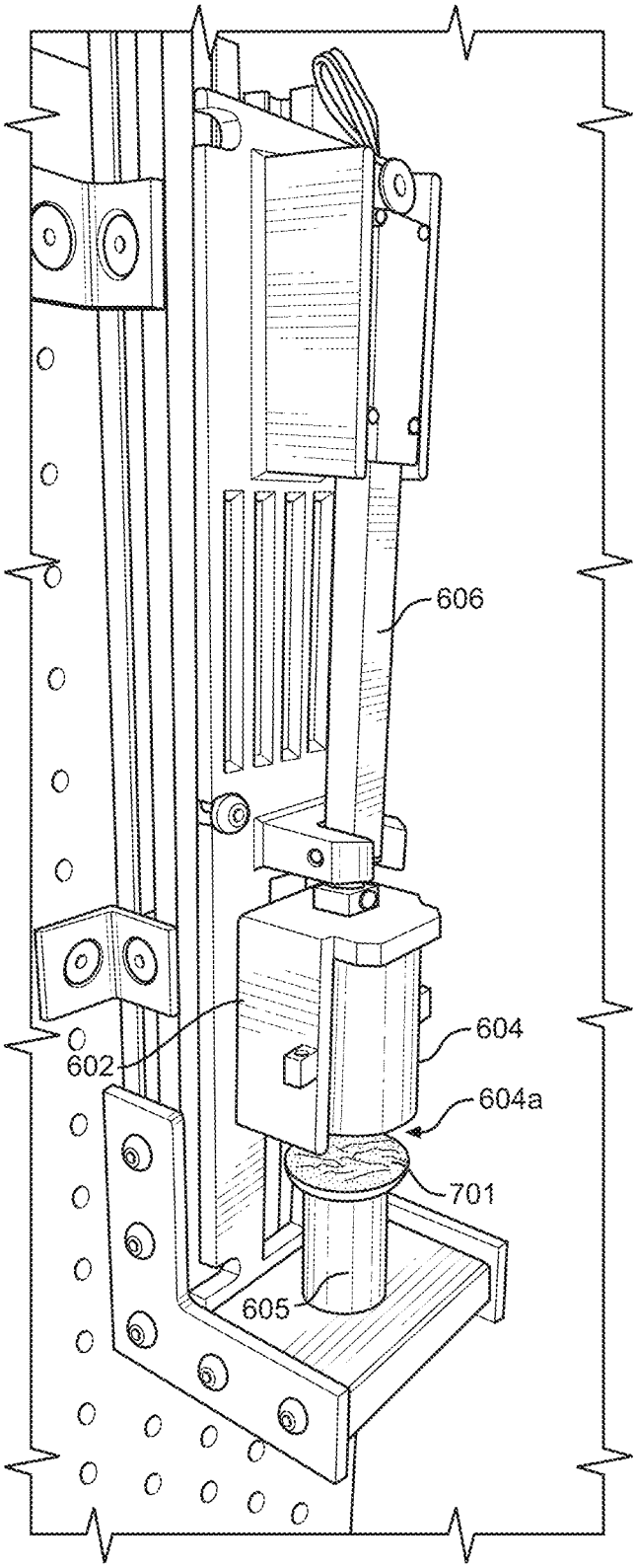
FIG. 7B shows a perspective view of an embodiment of the apparatus for extruding polishing paste and a paste container.

Referring now to FIG. 7A and FIG. 7B, there are shown two perspective views of an embodiment of the apparatus for extruding polishing paste. In these FIGs the apparatus 600 is shown in a vertical configuration. This will allow for the paste 701 to exit the extruder nozzle 605*a* and have gravity pull the paste 701 onto the desired surface. In other embodiments the apparatus for extruding polishing paste 600 may be placed in a horizontal configuration.

Using the apparatus for extruding polishing paste 600 prevents the need for the paste 701 to be removed from the container it comes in. Further, the apparatus for extruding polishing paste 600 does not require the container 603 to be altered or disassembled in any manner. The paste opened end 604*a* of the paste container 603 is placed against the extruder 605 then the paste container 603 is shut within the container compartment 602. This prevents the container 603 from bursting under pressure. The actuator 606 then presses the container compartment 6002, not the container 603 itself. This forces the container 603 downward.

In this embodiment the extruder 605 is held firm in place. The downward movement of the container 603 forces the extruder 605 into the container 603, the paste 701 is then forced into the interior of the extruder 605 and out of the extruder nozzle 605*a*. In different embodiments different container sizes and shapes may be used. The different shapes and sizes need to be accounted for in order to prevent paste 701 from being pushed out of the container 603 next to the extruder 605. In one embodiment the o-ring 605*b* will prevent this leak from occurring. In different embodiments different extruders 605 having different shapes or sizes may be used to match the interior specifications of the container 603.

In one embodiment the amount of paste 701 extruded can be accounted for by a correlation between paste 701 volume extruded and linear distance the actuator 606 is moved. This will allow a user to control the amount of paste 701 extruded by having the system move the actuator 606 a specified amount. This will further allow a system to determine when a container 603 is empty. By entering the depth of the container 603 into the system the system can determine the container 603 is empty once the actuator 606 moves a distance equal to the depth of the container 603.

While not explicitly shown the apparatus can have instructions stored in a non-transitory medium of the computer. The computer is operably coupled to the actuator such that the computer is configured to control the actuator. The computer can, based on the movement of the actuator display information such as extruded amount or if the container is empty.

Figure 8:
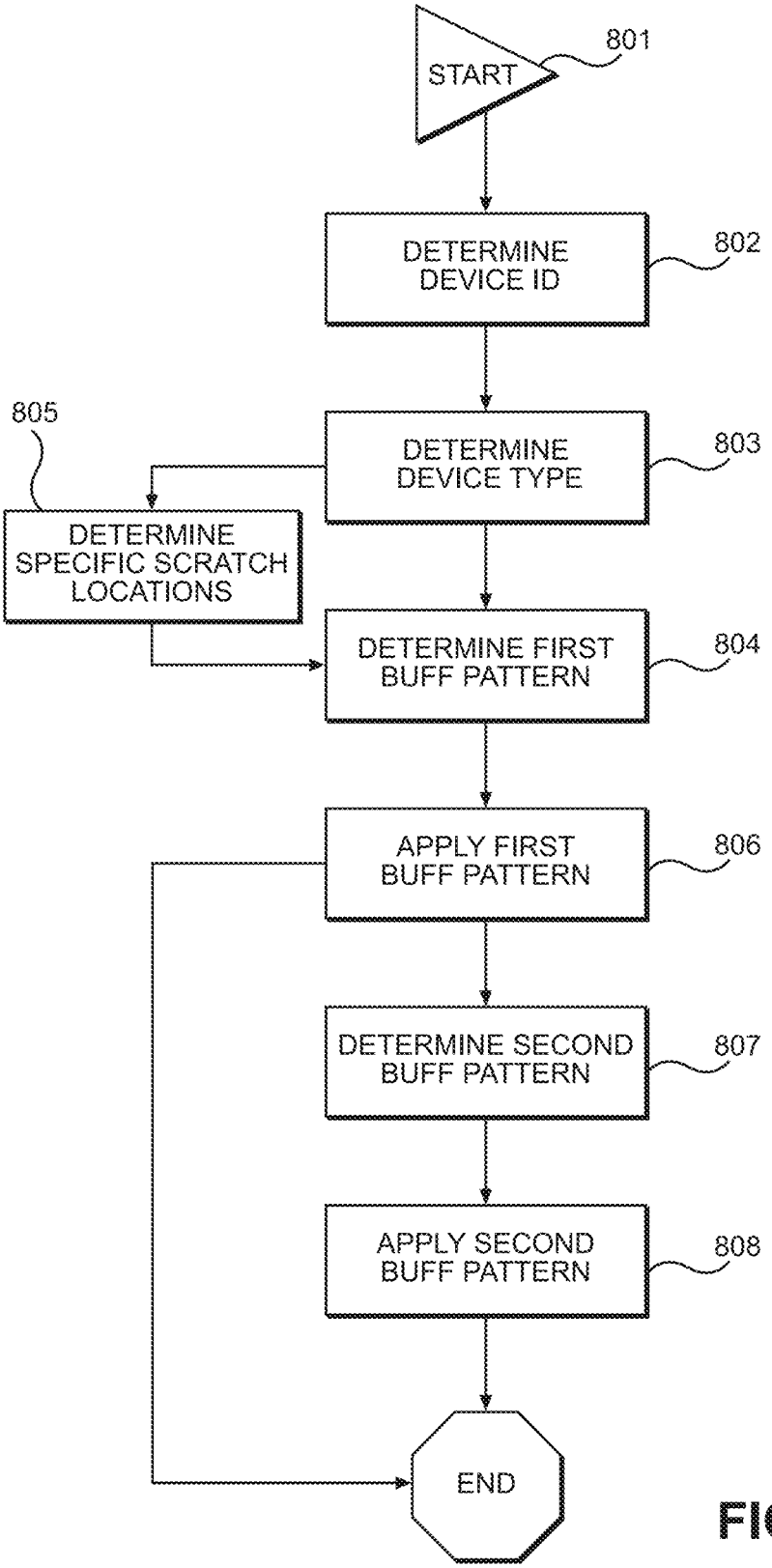
FIG. 8 shows a flow chart of an embodiment of the method for polishing the screen of an electronic device.

Referring now to FIG. 8, there is shown a flow chart of an embodiment of the method for polishing the screen of an electronic device. The method starts 801 by determining an electronic device ID 802. The electronic device ID may be, but is not limited to, an IMEI, a serial number, or organizational custom identification number. After the electronic device ID number is determined the electronic device type is determined 803. The electronic device type may be the type of device, the make of the device, and the model number for the electronic device. In some embodiments this information is determined based on the electronic device ID.

A first buff or polishing pattern must be determined 804. The first buff or polishing pattern may include the length and width of the pattern as well as the potential movements of the polishing device. This pattern may also include the amount and type of polishing paste to be used. In one embodiment specific scratches are targeted with individual buffing and polishing. In this embodiment the specific scratch locations will be determined 805. The determination of the first buff or polishing pattern could include applying a targeted buff to these scratch locations. After the first buff or polishing pattern is determined, the first buff or polishing pattern is applied 806. After the first buff or polishing pattern is determined the first buff or polishing patterned is applied to the electronic device 806.

In one embodiment the method ends after the application of the first buff or polish. In another embodiment a second buff or polish is applied to the electronic device. In a similar way to the determination of the first buff or polishing pattern a second buff or polishing pattern is determined 807. In many embodiments the second buff or polishing pattern will polish the entirety of an electronic devices screen, while the first buff or polishing is a targeted buff for deeper scratches. After the second buff or polishing pattern is determined it is applied 808, then the method ends. In additional embodiments additional buffs or polishes may be applied to an electronic device without departing from this method.

It is therefore submitted that the methods, systems, and devices have been shown and described in what is considered the most practical and preferred embodiments along with specific examples. It is recognized, however, that departures may be made within the scope and these present examples are not intended to be limiting. One of ordinary skill the art will be able to discern that obvious modifications can be made without departing from the scope or spirit.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Similarly, it is to be realized that, it is not intended for any method set forth herein to be construed as requiring that its steps be performed in a specific order, unless otherwise set forth in the claims.

Therefore, the foregoing is considered as illustrative only of the principles of the disclosure. Further, since numerous modifications and changes will readily occur to those skilled in the art, it is not desired to limit the invention to the exact construction and operation shown and described, and accordingly, all suitable modifications and equivalents may be resorted to, are deemed to fall within.

What is claimed:

1. An electronic device screen polishing apparatus, the apparatus comprising:

a frame creating a first compartment;

the first compartment houses a polishing device positioned above a movable table;

an apparatus for extruding polishing paste, wherein the apparatus for extruding polishing paste is secured above the movable table;

the apparatus for extruding polishing pasted is comprised of a mounting bracket having an actuator secured thereto;

the actuator is placed inline with a container holding compartment;

an extruder is secured to the mounting bracket below the container holding compartment such that one end will be in fluid contact with an open end of a container when the container is placed in the container holding compartment;

a computer having a non-transient storage medium;

a logic stored on the non-transient storage medium, wherein the logic defines a polishing sequence; and wherein the polishing sequence defines polishing of an electronic device screen.

2. The electronic device screen polishing apparatus of claim 1, wherein the polishing machine is secured to an actuator, wherein the actuator moves the polishing machine in a vertical direction.

3. The electronic device screen polishing apparatus of claim 2, wherein the actuator is configured to apply a specific designated pressure to the polishing machine, wherein the pressure is created between a electronic device screen and the polishing machine.

4. The electronic device screen polishing apparatus of claim 1, further comprising a first actuator secured to the movable table, wherein the first actuator moves the movable table in a X direction.

5. The electronic device screen polishing apparatus of claim 4, further comprising a second actuator secured to the first actuator, wherein the second actuator moves the movable table in a Y direction.

6. The electronic device screen polishing apparatus of claim 1, further comprising a platform secured to the movable table;

the platform includes a plurality of sidewalls which secure an electronic device therein.

7. The electronic device screen polishing apparatus of claim 1, wherein, when a container is forced toward the extruder the contents of the container will be forced though a nozzle end of the extruder in a desired amount.

8. The electronic device screen polishing apparatus of claim 5 wherein the apparatus for extruding polishing paste is positioned such that the movable table can be positioned under the apparatus for extruding polishing paste by a combination of movements of the first actuator and the second actuator.

9. The electronic device screen polishing apparatus of claim 8, wherein, when a container is forced toward the extruder the contents of the container will be forced though a nozzle end of the extruder in a desired amount.

* * * * *